United States Patent [19]

Reitter, II

[11] Patent Number: 4,558,552

[45] Date of Patent: Dec. 17, 1985

[54] BUILDING PANEL AND PROCESS FOR MAKING

[75] Inventor: Richard G. Reitter, II, Columbus, Ohio

[73] Assignee: Reitter Stucco, Inc., Columbus, Ohio

[21] Appl. No.: 512,025

[22] Filed: Jul. 8, 1983

[51] Int. Cl.[4] ..... E04B 1/16; E04G 21/00

[52] U.S. Cl. ..... 52/741; 52/410; 52/454; 156/91

[58] Field of Search ..... 29/526 R, 460; 428/313.5; 264/DIG. 7, 46.5, 46.6, 46.7; 52/741, 443–445, 601, 612, 452, 454, 746, 747, 410; 156/91, 92, 154, 280

[56] References Cited

U.S. PATENT DOCUMENTS

| | | | |
|---|---|---|---|
| 1,152,860 | 9/1915 | Stoetzer | 52/445 |
| 1,402,593 | 1/1922 | Gauvin . | |
| 1,510,224 | 9/1924 | Hicks . | |
| 1,609,938 | 12/1926 | Forrest | 52/612 |
| 1,740,898 | 12/1929 | Lawrence . | |
| 1,983,020 | 12/1934 | De Vol | 52/601 |
| 2,162,861 | 6/1939 | Polak | 72/17 |
| 2,305,684 | 12/1942 | Foster | 52/601 |
| 2,370,052 | 2/1945 | Lindelow | 72/118 |
| 2,382,474 | 8/1945 | Gambo | 72/118 |
| 2,412,744 | 12/1946 | Nelson | 72/16 |
| 2,983,080 | 5/1961 | Whiteside | 50/338 |
| 3,289,371 | 12/1966 | Pearson et al. | 52/741 |
| 3,401,494 | 9/1968 | Anderson | 52/309 |
| 3,736,715 | 6/1973 | Krumwiede | 52/601 |
| 3,867,800 | 2/1975 | Elliott | 52/452 |
| 4,059,939 | 11/1977 | Elliott | 52/745 |
| 4,185,437 | 1/1980 | Robinson | 52/601 |
| 4,265,964 | 5/1981 | Burkhart | 428/313.5 |

*Primary Examiner*—James L. Ridgill, Jr.
*Attorney, Agent, or Firm*—Sidney W. Millard

[57] ABSTRACT

A building panel formed with a framework of metal channels has a pressed fiberglass panel attached to one surface. A metal mesh over the fiberglass is secured to the framework by screws which pass through the mesh and fiberglass and into the channels. A layer of a mixture of portland cement, expanded polystyrene beads, and water is applied over the metal mesh and a fiberglass mesh is embedded in the layer near its outer surface. A coating is applied to the layer, the coating being a mixture of portland cement, aggregate, and water.

18 Claims, 2 Drawing Figures

BUILDING PANEL AND PROCESS FOR MAKING

FIELD OF THE INVENTION

This invention relates to building panels for commercial or residential construction which allows the control of heat transfer properties without changing the basic support structure of the panel.

BACKGROUND OF THE INVENTION

Building panels of various kinds have been constructed over the years with innumerable external facings and innumerable insulating materials associated therewith. However, they all have drawbacks which make them more or less desirable under diverse circumstances.

It has been customary in various phases of the industry to construct building panels with a cavity between two surfaces and fill the cavity with insulating material such as fiberglass rockwool. But the problem with the cavity concept is that the insulation tends to compact over time and settle to the bottom of the cavity, thereby creating a tremendous heat transfer coefficient differential between the top and the bottom of the wall.

Pressed insulation board in combination with poured concrete is another conventional type of wall panel used. Ordinarily, this type of structure is a prefabricated panel where the fiberboard is disposed either on the top or bottom of a concrete slab with tie bars extending through both elements before the concrete hardens. One problem with this structure is the control of the heat transfer coefficient by moving the wall surface inward as the insulation thickness is increased; thereby reducing the internal dimensions of the rooms of the structure.

A third common panel construction includes filling the cavity between the external sheathing and the internal drywall with a foamed resin. Usually the resin is injected after the wall panel is erected. In this case, the heat transfer coefficient is controlled by the foam density and its thickness. The thickness in turn is controlled by the standard thicknesses of the support elements within the wall. Accordingly, the building resident cannot specifically control the heat transfer coefficient; he can only change in from one fixed value to another.

BRIEF DESCRIPTION OF THE INVENTION

A metal framework is provided and a pressed layer of fiberglass is attached to the intended outside surface thereof, and over this is applied a self-furring metal mesh. Sheet metal screws penetrate the mesh, fiberglass and framework to thereby attach the two former into a semi-rigid assembly with the framework.

A combination of expanded polystyrene beads, portland cement, and water is mixed to a consistency which allows easy application of the wet mixture as a layer over the metal mesh. The thickness of the wet layer is optional. The purpose of the expanded polystyrene beads is to serve as an insulation in the wall itself and its combination with the other ingredients will serve to maintain the polystyrene beads in permanent position throughout the life of the wall, thereby providing a uniform thermal coefficient through the wall throughout its life. The degree of insulation will be controlled by the percentage of polystyrene in the layer and the thickness of the wall and that is controlled by the manufacturer who designs the wall according to its particular need.

A fiber mesh with openings of about $\frac{3}{8}$ inch is then applied over the wet layer and its purpose is to supply dimensional stability and prevent surface cracking of the layer. The mesh is troweled into the wet grout surface to cause the grout to ooze through the openings. It is required that the mesh be completely covered to allow subsequent surface treatment without severing the mesh strands. A second layer of the polystyrene mixture may be applied over the fiber mesh if desired or needed and the panel is then allowed to stand idle for about twelve to twenty-four hours to allow a certain amount of curing of the cement.

When the surface reaches a consistency approximately equivalent to cheddar cheese, the surface will be rasped to remove the sheen from the surface. This will facilitate the bonding of the next layer. Care must be taken in the rasping process to prevent any severing of the fiberglass strands. Then the panel is allowed to stand for about another twenty-four hours to allow for hydration of the cement.

The last step in the manufacturing process is the application of a surface coating to the rasped surface which will comprise a mixture of cement, aggregate and water, and if desired for asthetic purposes, any adequate pigment for color will be suitable. The outer surface will serve to (1) minimize the penetration of water into the polystyrene bead layer and (2) screen the polystyrene from the direct rays of the sun. Prolonged exposure to sunlight causes deterioration of the beads with the resultant deterioration of the insulation effect.

Objects of the invention will be clear from a detailed reading of the Description of the Preferred Embodiment and an observation of the drawings.

DESCRIPTION OF THE PREFERRED EMBODIMENT

Figure 1:
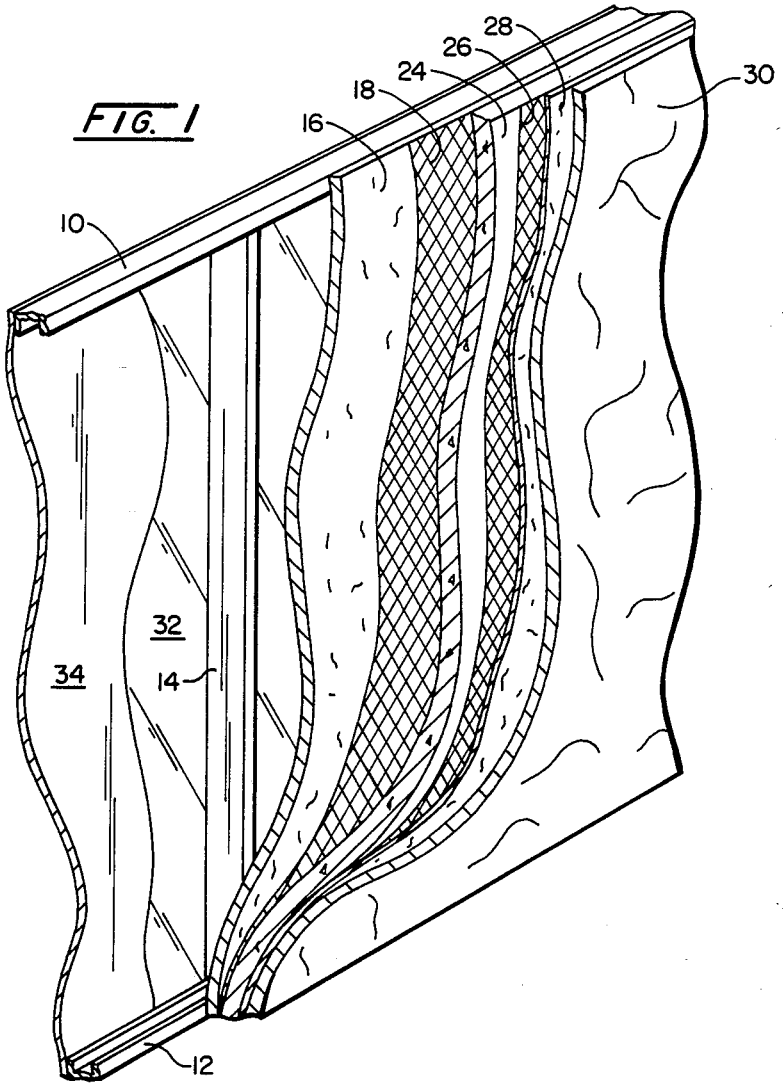
FIG. 1 is a fragmentary elevational view of a wall manufactured according to the invention.
Figure 2:
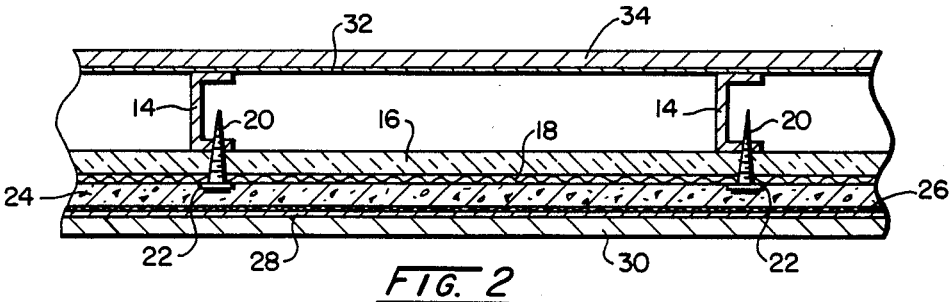
FIG. 2 is a sectional view of the wall of FIG. 1.

Looking to FIG. 1, a wall panel according to the invention is shown in upright position but in the intended manufacturing procedure, it will be assembled while horizontal. In the manufacturing process, the first thing to be accomplished is to construct a metal framework from the U-shaped metal channels illustrated and it will include a top channel 10 and a bottom channel 12. Bridging the space between channels 10 and 12 are a plurality of intermediate channels 14. The channels are welded or otherwise mechanically attached together to form a rigid structure. Channels 14 are preferably spaced about sixteen to twenty-four inches apart. Diagonal bracing elements are sometimes conventionally used but are not shown to simplify the illustration of the inventive concept.

After the framework is suitably joined and laid horizontally in place, a panel of compressed fiberglass 16 is laid on the upper surface. The compressed fiberglass panel may be from one-half to two and one-half inches in thickness and the transverse dimensions of the fiberglass panel are conventional in that they are about four feet by eight feet.

A self-furring mesh 18 is disposed on the fiberglass panel and the elements are secured to the framework by metal screws 20 projecting from the metal mesh through the fiberglass and into the intermediate channels 14. To prevent the heads of the screws 20 from slipping through the metal mesh, large washers 22 may be placed between the head of the screw and the metal mesh, thereby more securely holding the mesh in place. Alternatively, large headed screws may be used. Screws 20 are spaced apart about six to eight inches and are included in each channel 14.

The purpose of the compressed fiberglass panel 16 is to serve as an insulation to the wall. The purpose of the metal mesh is to provide an attachment for a particular grout mixture which will be applied thereon, after it has been secured in place. The grout mixture in question is a combination of expanded polystyrene beads, cement, and water which may be applied to the mesh by trowelling or by a spray nozzle. At the time it is applied it should be of a consistency less viscous than putty to allow easy manipulation and settling to a certain extent by gravity to provide a smooth surface after it is applied, not that a smooth surface is necessarily desirable, it is only that a relatively uniform thickness is desirable. The metal mesh will provide crevices and cavities for the incursion of the mixture. Thereby, when the mixture hardens it will serve to reinforce and strengthen the metal mesh. The metal mesh provides strength in tension. The hardened mixture will provide strength in compression The mixture of polystyrene beads with the cement is for the purpose of having a predictable insulation factor and that is accomplished by the volumetric percentage of the polystyrene and the thickness of the layer 24. It has been found that applying the layer 24 in one phase or application of greater than two inches tends to cause problems of uniformity and often voids are created. Therefore, it is preferred that the layer 24 be built up in a series of phases or layers of no greater than about two inches per application. Additionally it is preferred that the layer formed by the mixture of polystyrene beads be no more than about six inches in thickness because greater thicknesses are only marginally better insulators.

After the layer 24 has been applied to the approximate desired thickness based on the insulating factor desired, a fiber mesh 26 having openings of about $\frac{3}{8}$ by $\frac{3}{8}$ inches will be applied to the surface of the wet layer. Because of the chemical nuture of portland cement, it is desirable that the fiber mesh 26 and preferably the fiberglass panel 16 be of alkali resistant fibers. Fiberglass is the preferred material for the mesh 26 but other materials such as nylon, properly treated, may be used.

The fiber mesh 26 provides surface stability and in particular minimizes cracking of layer 24 at its surface. After it is placed on the wet surface it is trowelled into the cementaceous mixture 24 unitl all fibers are covered and an outer layer 28 is formed. Alternatively, the layer 28 may be applied over the mesh 26 as a separate operation. In either case, the thickness of layer 28 should be no more than about one-quarter to three-quarter inches in thickness. Layer 28 must be thick enough to receive the subsequent rasping by a metal plate to roughen or score its surface without the plate engaging and tearing the strands of the mesh 26.

After the layer 28 is in place, it is desirable to let the panel stand idle for about twelve to twenty-four hours until the polystyrene mixture has reached a consistency approximately the same as chedder cheese, and at that point the process step of rasping the surface will be performed to facilitate bonding of an outer surface coating 30. The outer surface coating 30 comprises cement, aggregate, and water and may be applied by trowel or by spray nozzle. Any particular pigment for coloration of the coating may be appropriate, but the particular pigment chosen is not a part of this invention. However, what is significant in the manufacturing process is the fact that if the steps described are followed the wall will remain substantially as constructed for years. However, it has been found that if the rasping step is not accomplished and the timing sequence is not adhered to, the outer surface coating 30 will tend to peel away from the polystyrene layer, which is obviously undesirable.

It has been discovered during the course of research on this subject that after the rasping, the hydration process of the cement should be allowed to continue for about another twenty-four hours before the outer surface coating 30 is applied.

After the outer surface coating 30 about one-quarter inch thickness is applied, the panel should be allowed to remain stationary for another twenty-four to forty-eight hours before it is moved. By that time, sufficient cement hydration will have occurred and the elements will be hard enough that they will adhere to the fiberglass mesh 24 and the metal mesh 18 and cracking will not occur if the panel is lifted onto a truck for shipping or applied directly to the foundation of a building.

Looking now to the opposite side of the structure which will be the interior of the wall, a vapor barrier 32 fits between the metal framework 14 and the drywall 34. The drywall is conventional and the vapor barrier itself is of polypropylene and its thickness is minimal.

Having thus described the invention in its preferred embodiment, it will be clear that modifications may be made to the structure described without departing from the spirit of the invention. Accordingly, it is not the intention of the inventor that the invention be limited by the words used in the specification, nor the drawing used to illustrate the same. Rather it is intended that the invention be limited only by the scope of the appended claims.

I claim:

1. A process for making a building panel comprising constructing a framework from metal channels including a top channel, a bottom channel and a plurality of intermediate channels, said intermediate channels extend from said top channel to said bottom channel and are mechanically attached to the top and bottom channels, said intermediate channels being spaced apart about sixteen to twenty-four inches, the process comprising, in sequence, laying the framework on a horizontal surface, applying a fiberglass panel to the upper side of the framework, applying a metal mesh over the fiberglass panel, securing the framework, panel and mesh together by a plurality of metal screws passing from the mesh to the framework, providing a mixture of cement, expanded polystryene beads, the water of a consistency less viscous than putty and applying a layer of the mixture up to six inches thick to the exposed face of the mesh, while the layer is wet, applying a fiber mesh over the layer, trowelling the mesh into the wet layer to cover all mesh fiber, leaving the panel thus formed in stationary horizontal position for a period of about twelve to twenty-four hours until the layer achieves approximately the consistency of chedder cheese, rasping the exposed surface of the layer at the time it is the consistency of chedder cheese to create an exposed roughened surface, and applying a coating to the rasped surface, the coating comprising a mixture of cement, aggregate, and water.

2. The process of claim 1 wherein the coating is applied in one step of a thickness of about one-quarter inch.

3. The process of claim 1 including applying a vapor barrier to the other side of the framework.

4. The process of claim 3 including applying drywall over the vapor barrier.

5. The process of claim 1 including applying a second layer of the mixture over the fiber mesh prior to rasping, the second layer is of a thickness of about one-quarter to three-quarter inch.

6. The process of claim 5 wherein the coating is applied in one step of a thickness of about one-quarter inch.

7. The process of claim 1 wherein the screws are applied with about six to eight inch vertical spacing.

8. The process of claim 7 including applying a second layer of the mixture over the fiber mesh prior to the rasping, the second layer is of a thickness of about one-quarter to three-quarter inch.

9. The process of claim 8 wherein the coating is applied in one-step of a thickness of about one-quarter inch.

10. The process of claim 1 wherein the layer is not greater than about six inches in thickness and the layer is applied in one or more phases with no phase applied being greater than about two inches in thickness.

11. The process of claim 10 wherein the screws are applied with about six to eight inch vertical spacing.

12. The process of claim 11 including applying a second layer of the mixture over the fiber mesh prior to the rasping, the second layer being of thickness of about one-quarter to three-quarter inch.

13. The process of claim 12 wherein the coating is applied in one step of a thickness of about one-quarter inch.

14. The process of claim 1 including inserting a washer between the heads of the screws and the metal mesh to prevent the screw heads from slipping between the openings in the mesh.

15. The process of claim 14 wherein the layer is not greater than about six inches in thickness and the layer is applied in one or more phases with no phase applied being greater than about two inches in thickness.

16. The process of claim 15 wherein the screws are applied with about six to eight inch vertical spacing.

17. The process of claim 16 including applying a second layer of the mixture over the fiber mesh prior to the rasping, the second layer being of a thickness of about one-quarter to three-quarter inch.

18. The process of claim 17 wherein the coating is applied in one step of a thickness of about one-quarter inch.

* * * * *